US005775833A

United States Patent [19]

Little

[11] Patent Number: 5,775,833

[45] Date of Patent: Jul. 7, 1998

[54] COLLAPSIBLE, BREAKAWAY HIGHWAY DELINEATOR

[75] Inventor: David Little, Wellsville, Utah

[73] Assignee: Rotational Molding of Utah, Brigham City, Utah

[21] Appl. No.: 666,019

[22] Filed: Jun. 19, 1996

[51] Int. Cl.[6] ..... E01F 9/018

[52] U.S. Cl. ..... 404/9; 404/10; 116/63 P

[58] Field of Search ..... 404/9, 10, 11, 404/6; 116/63 P, 63 C, 63 T; 40/607, 612

[56] References Cited

U.S. PATENT DOCUMENTS

| | | | |
|---|---|---|---|
| 2,954,005 | 9/1960 | Cioffi et al. | 116/63 C X |
| 3,123,041 | 3/1964 | Gunderson | 116/63 P |
| 3,526,200 | 9/1970 | Doyle . | |
| 3,792,678 | 2/1974 | Rowland . | |
| 4,253,415 | 3/1981 | Ferch | 116/63 P |
| 4,762,439 | 8/1988 | Carlyle | 404/11 X |
| 5,303,668 | 4/1994 | Huang . | |
| 5,329,875 | 7/1994 | Feuvray . | |
| 5,482,398 | 1/1996 | Finke . | |
| 5,484,225 | 1/1996 | Warner | 404/9 |
| 5,529,429 | 6/1996 | Pelegrin | 404/9 |
| 5,580,156 | 12/1996 | Suzuki et al. | 362/800 X |
| 5,592,898 | 1/1997 | Korpi | 116/63 P X |
| 5,670,954 | 9/1997 | Junker | 404/10 X |

FOREIGN PATENT DOCUMENTS

| | | | |
|---|---|---|---|
| 570954 | 11/1993 | European Pat. Off. | 404/9 |
| 3412999 | 7/1985 | Germany | 404/10 |
| 3718440 | 12/1988 | Germany | 404/9 |
| 4312673 | 10/1994 | Germany | 404/9 |
| 2194577 | 3/1988 | United Kingdom | 404/9 |

OTHER PUBLICATIONS

Brochure, T-Top Delineator Post (Bent Manufacturing Co.).

Brochure, Delineator Post Bases (Bent Manufacturing Co.).

Brochure, Delineator Post Bases (SDI, Scientific Developments, Inc.).

Brochure, "Traffic Delineation Devices" (Bent Manufacturing Co.).

Brochure, "MSi Durastem Recycled Vertical Panel Barricade" (A Woudenberg Enterprises Co.).

Brochure, Klemm Fix Traffic Barrier Systems "The portable Klemmfix Leit-Curb System The leap ahead" by Qwick Kurb.Inc.

Brochure, Safety Cade Barricades "The Ultimate Barricade System", (WLI Industries, Inc.).

Brochure, "TrafFix Sign, Stand and Flag" & Plastic Channelizer Drum, (TrafFix Devices Inc.).

Cataloge, "Impact Recovery Systems" (Impact Recovery Systems)).

*Primary Examiner*—James Lisehora

*Attorney, Agent, or Firm*—Thorpe North Western

[57] ABSTRACT

A breakaway highway delineator including a base member for resting on a roadway or other generally horizontal surface and a base member which is connected to the panel member. In a preferred embodiment, the panel member is moveable between a first, generally horizontal orientation and a second, generally vertical orientation. The base member has a cavity/receiving slot configured to hold part of the panel member when the panel member is disposed generally horizontally. The base member also interacts to hold the panel member generally vertical when the panel member is properly positioned within the base member so as (i) to prevent the panel member from being tipped over by gusts of wind and drafts created by trucks and other vehicles passing by the delineator, and (ii) to release the panel member when forcefully impacted, allowing the panel member to be pulled from the base member to minimize damage to vehicles.

36 Claims, 8 Drawing Sheets

COLLAPSIBLE, BREAKAWAY HIGHWAY DELINEATOR

BACKGROUND OF THE INVENTION

1. Field of the Invention

The present invention relates to a movable highway delineator which is used to mark temporary boundaries along roadways so as to warn travelers of road construction, repair or other road hazards. In particular, the present invention relates to a collapsible, breakaway delineator which improves storage ability, is easier to set up than most embodiments of the prior art, and which provides improved performance and durability during use.

2. State of the Prior Art

The use of movable delineators to mark temporary boundaries along roadways is extremely common. The delineator enable drivers to know which area should not be driven on due to construction, road repair, road hazards and other potential dangers. Because such delineators are necessary to properly control traffic and avoid injury, transportation departments and contractors spend considerable sums of money acquiring delineators which will clearly mark the temporary boundary of the road in an appropriate manner. However, all of the presently available delineators suffer from one or more disadvantages which increase the cost of use and/or pose a risk of property damage to those who accidentally collide with the delineator.

One common method of indicating a temporary road boundary is to place concrete barriers along the boundary so as to prevent traffic from crossing into the area that is being constructed or is under repair. The concrete barriers are extremely effective at preventing traffic from entering the area which has been sectioned off. The concrete barriers, however, suffer from numerous disadvantages. First, the concrete barriers are extremely heavy and require considerable amounts of machinery and man hours to properly position along the boundary to be delineated. Second, the concrete barriers are often difficult to see at night unless additional reflective devices are placed thereon so as to enhance their visibility. Third, should a car accidentally contact the barriers, considerable damage is done to the vehicle. If the impact is severe enough, the occupants of the vehicle may even be harmed. For these reasons, concrete barriers are typically only used on long-term projects and projects wherein construction or repair crews would be in harms way if a rigid barrier were not provided.

Another common method for delineating a temporary boundary is the use of a structure commonly referred to as a barricade. The barricade has a metal A-shaped frame which can be collapsed to be substantially flat. The frame typically has two panels placed on each side. Each panel is typically coated or covered with reflective stripes to enhance visibility by drivers. The barricades are generally light weight and easy to set up, thereby facilitating rapid placement by road construction/repair crews. However, the light weight in combination with the reflective panels renders the barricades extremely susceptible to movement by wind. Thus, during a wind storm or when a barricade is passed in close proximity by a large truck, it is common for the barricade to move or tip over.

To overcome such problems, a sandbag is typically placed on one of the reflective panels of the barricade to provide an anchoring weight. However, the use of sandbags requires additional man-hours, equipment, cost and raises safety concerns. If a barricade is impacted by a vehicle, the sandbag (which is typically disposed 18 to 24 inches off the ground) can forcibly impact the vehicle, thereby causing considerable body damage and potential harm to the occupants. Additionally, the barricade maybe thrown into traffic coming from the opposing direction thereby impacting more vehicles, causing more property damage and potentially additional bodily harm. After impacting one or more vehicles, the twisted metal frame is typically no longer usable as a delineator.

Another approach to delineating boundaries on the roadways is the use of stackable barrels or cones. The barrels and cones are advantageous as they can be stacked one on top of the other so that a significant number of barrels or cones may be stored in a small space. Additionally, the barrels or cones are generally light weight which limits their transportation cost.

As with the barricades, however, the barrels and cones are susceptible to being blown out of place by wind storms or by large trucks which pass close to the device. The problem is particularly bad because the barrels and cones typically have a greater surface area with which to be caught by the wind. Additionally, because the sidewall of the barrel or cone is generally annular, the position cannot be adjusted to minimize the risk of tipping even in locations having a prevailing wind pattern.

To remedy these concerns, sandbags have been used about the base of the barrel or cone. However, the sandbags require additional time and expense to properly position and can cause other problems. A sandbag will typically break after it has been used three to four times. When the sandbag breaks, the sand spreads across the road and provides an impediment to wheels of automobiles properly contacting the road. In an emergency breaking situation, a sufficient amount of sand can cause the automobile to skid, rather than slowing appropriately. Therefore, if sand is used as a weighting material, containment must be assured.

An additional problem with barrels or cones is the marking device can itself present a hazard. When the barrel or cone is struck by a vehicle, the sandbag is often left on the road and the barrel or cone is thrown into oncoming traffic. The moving barrel or cone can cause additional damage and increases the risk of multi-vehicle accidents.

To overcome these concerns, several manufactures have taken the approach of providing a weighted base with a delineator rigidly attached thereto and extending upwardly therefrom. Such an arrangement has an advantage of requiring little assembly or setup time when marking the temporary boundary. However, such a configuration has several problems. First, the rigid attachment between the base and the upward extending panel member significantly limits the number of delineators which may fit on a truck or other carrying device. Second, unless the base is relatively small, impacting the panel member with a car causes the base to flip upwardly and into forcible contact with the undercarriage of the car, thereby causing body damage as well as potential injury to the occupants of the vehicle.

To alleviate some of these concerns, delineator arrangements have been provided wherein the base is attached to the upwardly extending panel member by a spring or other member which pivots when impacted by a vehicle. Thus, when the panel member is forcibly impacted by a vehicle, the panel member pivots from a generally vertical orientation to a generally horizontal orientation and then returns to an upright position once the vehicle has passed. Such arrangements, however, are typically expensive and have a limited useful life. Additionally, such delineators are difficult to stack for transport or storage. If a panel member is bent into a generally horizontal orientation for long term storage, the attachment with the base member tends to loose its ability to restore the panel member to an upright position. If the panel member is detached from the base, countless hours are wasted disassembling and reassembling the devices.

Thus there is a need for an improved, movable highway delineator for marking boundaries wherein the delineator may be conveniently stored without consuming considerable amounts of space, and wherein the delineator can be easily setup along the roadway so as to mark a boundary. Additionally, such a delineator should have a mechanism for holding the same in place so as to not be easily moved by wind and other natural forces. If a weighting material such as sand or water is used, the delineator should provide an adequate holding mechanism to prevent spills of the weighting material. Furthermore, the delineator should be constructed so as to minimize damage to vehicles contacting the delineator and to avoid the risk of the delineator would be thrown into opposing traffic in such a manner as to create the likelihood of additional accidents and damage to other vehicles.

SUMMARY OF THE INVENTION

It is an object of the present invention to provide a movable highway delineator which may be conveniently folded to a flattened configuration for shipment and storage, and which may be quickly and easily converted into an upright configuration wherein the delineator can be aligned with other similar delineators to mark a boundary.

It is another object of the present invention to provide such a foldable delineator which may be arranged in a stacked configuration to maximize the number of delineators which may be transported by a single vehicle.

It is another object of the present invention to provide a weighted delineator which resists tipping in response to gusts of wind and drafts created by vehicles passing adjacent thereto.

It is another object of the present invention to contain a weighting material used in the delineator to prevent spills on the roadway which might increase the risk of accidents.

It is yet another object of the present invention to provide such a delineator which resists crawling/snaking in response to vibrations of the delineator.

It is still another object of the present invention to provide a breakaway delineator which separates into components when impacted by a vehicle so as to minimize damage to the vehicle and any oncoming traffic with which the delineator may collide.

The above and other objects of the invention are realized in specific illustrated embodiments of a collapsible, breakaway highway delineator including a base member for resting on a roadway or other generally horizontal surface and a panel member which is connected to the base member and is moveable between a first, generally horizontal orientation and a second, generally vertical orientation. The base member has a receiving slot configured to hold part of the panel member when the panel member is disposed generally horizontally. The base member also interacts to hold the panel member generally vertical when the panel member is properly attached to the base member, to prevent the panel member from being tipped over by gusts of wind and drafts created by trucks and other vehicles passing by the delineator.

In accordance with one aspect of the invention, the base member is substantially hollow to facilitate shipping of the delineators. A fill hole or orifice is provided in the base member to enable the user to fill the base with sand, water or other fill material to increase weight and prevent tipping of the delineator.

In accordance with another aspect of the invention, the base member is provided with a plurality of vents. The vents facilitate the drainage of snow and ice, and help to prevent the base member from being tipped over by sudden gusts of wind.

In accordance with still another aspect of the present invention, the base member is provided with a bottom contact rim which engages a groove in the top of other similarly configured base members to form a tongue and groove arrangement to facilitate stacking of the delineators for storage or transportation. Additionally, the contact rim is formed to localize the pressure exerted on the road surface for better frictional interface and to minimize movement of the base member when it is impacted by an automobile. Such an arrangement actually decreases the crawling or snaking which occurs due to vibration of the base member, as opposed to the conventional teaching to maximize the area of the underside of the base member which contacts the road surface.

Still another aspect of the present invention is the mechanism associated with the base member by which the panel member is able to be pivoted into a horizontal orientation for storage and transport, and held substantially vertical during wind gusts and drafts created by vehicles passing immediately adjacent to the delineator.

Still another aspect of the present invention is a locking mechanism associated with the base member which allows the panel member to be held substantially vertical when in use, and which allows the panel member to temporarily break away from the base member when the panel member is impacted by a vehicle. By breaking free of the base member, the panel member prevents the base member from being forced into the undercarriage of the vehicle. Additionally, because the substantially flat panel member is the only part that is removed from its weighted position by the impact with the vehicle, there is a substantially lower risk that consequential damage will occur as the panel member slides across the road surface.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 1:
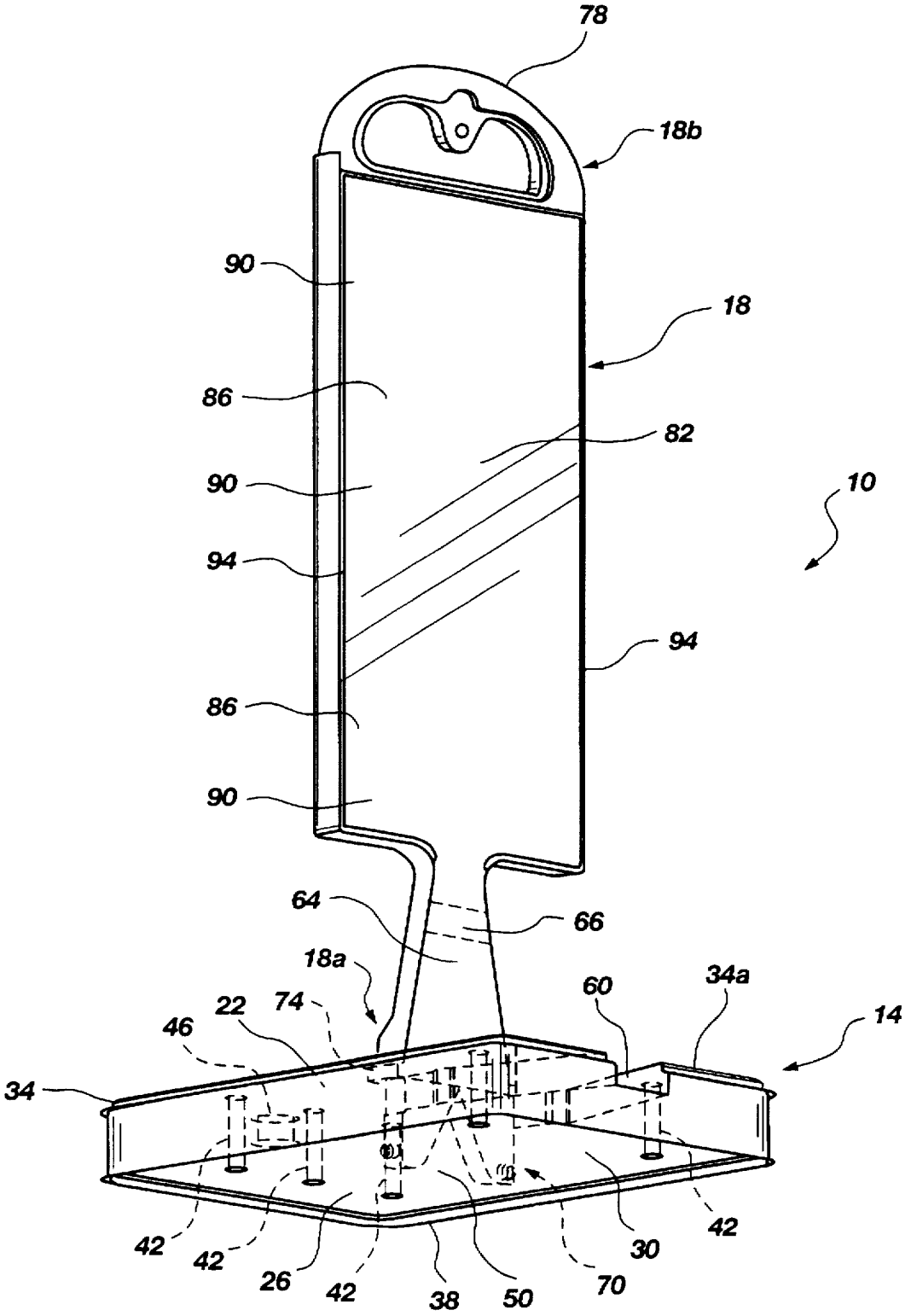
FIG. 1 shows a perspective view of a breakaway highway delineator made in accordance with the principles of the present invention.

Referring now to FIG. 1, there is shown a collapsible, breakaway highway delineator, generally indicated at 10, made in accordance with the principles of the present invention. The breakaway delineator 10 has a base member 14 and a sign/panel member 18 which is adjustably attached to the base member in such a manner that the panel member can be disposed in the same plane as the base member for transportation and storage, and generally perpendicular to the plane of the base when used as a delineator along highways and other travel surfaces.

As shown in FIG. 1, the base member 14 is formed by a generally rectangular structure having an upper wall 22 a lower wall 26 and a sidewall 30 disposed therebetween to connect the upper and lower surfaces. In the upper wall 22 a groove 34 is formed about the perimeter. A contact rim 38 is disposed about the perimeter of the lower wall 26 so as to extend downwardly therefrom. The contact rim 38 is disposed so as to mate with a groove (such as groove 34) on a similarly configured based member 14 to facilitate stacking of numerous base members on top of one another so as to maximize the number of delineators 10 which may be contained within a defined space.

Formed into the base member 14 are a plurality of structures which will be discussed in detail throughout the remainder of the application. Identified at 42 are a plurality of through-holes or vents which pass from the upper wall 22 to the lower wall 26. The vents serve several purposes. First, when snow or water accumulates on top of the base member 14, they are able to drain from the upper surface down through the vents 42. Second, the vents 42 provide an air passage. The air passage enables air disposed within a cavity beneath the lower wall 26 to be vented in the event that a vehicle's tire rolls over the base member 14. Additionally, as will be discussed in detail below, the vents 42 help prevent the base member 14 from being tipped over by sudden gust of wind.

Also shown in the upper wall 22 is an orifice 46 which provides a fill hole. Typically, the upper wall 22, lower wall 26 and side wall 30 are attached or molded so as to provide a hollow cavity 50 within the base member 14. The cavity 50 will remain hollow during shipment to the user, thereby keeping weight to a minimum. Once received, however, the cavity 50 is filled with a weighting/fill material such as sand, water or any other material desired by the user.

Such an arrangement provides several advantages. First the base member 14 and sign member 18 typically will have a combined weight of between 10 and 15 pounds. By filling the base member 14 with sand, the total weight of the breakaway delineator 10 is increased to between 40 and 55 pounds, of which 35 to 50 pounds is in the base member. Thus, the delineator 10 may be shipped at a relatively light weight and then more than tripled in weight for use along roadsides to prevent tipping due to wind gusts.

Also shown in the base member 14 is a cavity forming a receiving slot 60 for receiving a neck portion 64 which is disposed along an intermittent body 66 of the panel member 18 between the lower end **18*a* and the upper end 18*b*. The receiving slot 60 allows the neck portion 64 of the panel member 18 to be folded so that the panel member is generally horizontal and in the same plane as the base member 14**. Such a folding arrangement enables a plurality of breakaway delineators to be stacked one a top another, thereby dramatically increasing the number of delineators which may be shipped within a given volume. It has been found that such an arrangement typically increases the number of delineators that can be carried on a truck by 400 to 600 percent.

Those skilled in the art will appreciate that a major expense in road repair is due to the time necessary for road construction/repair crews to transport and properly position the delineators. By allowing one truck to carry a large number of delineators which can be quickly moved into a position for use along a roadway, considerable savings achieved both in employee time and equipment/transportation expenses. Rather than requiring three or four trucks and work crews to drive the trucks and position the delineators, and then another truck and crew to position sandbags on the bases, a single truck and a few employees can be used with the present invention to mark a substantial stretch of roadway.

Referring now to the panel member 18, the panel member has a lower end, generally indicated at **18*a*, and an upper end, generally indicated at 18*b*. The lower end 18*a* has an anchoring mechanism 70 which engages structures of the base member 14 to selectively hold the panel member in a generally vertical orientation. The functioning of the anchoring mechanism 70** is discussed in detail with respects to FIGS. 3A through 5B.

The anchoring mechanism 70 enables a user to manually position the panel member 18 in an upright position where the panel member remains until the user releases the anchoring mechanism 70, or until the panel member is forcible contacted by a vehicle. In either occurrence, the anchoring mechanism 70 releases the panel member 18 so that the panel member can either return to a horizontal orientation, or can break free of the base member to avoid lifting the base member into forceful contact with a vehicle impacting the panel member.

A shoulder 74 is provided to limit the depth at which the anchoring mechanism 70 is disposed within the base member 14, and to provide additional support to the neck portion 64 of the panel member 18. The shoulder 74 will typically extend along lateral sides of the neck portion 64 and will be between one-half and one inch thick.

At the opposing upper end **18*b* of the panel member 18, a handle 78 is provided. The handle 78 facilitates movement of the panel member 18 between horizontal and vertical orientations, and enables the entire breakaway delineator 10 to be conveniently lifted and moved by road/construction repair crews. Additionally, as discussed in detail in FIGS. 7A through 7D, the handle 78** forms a unique attachment mechanism for both conventional warning lights and those using light emitting diodes.

The panel member 18 provides a broad face 82 which can be used for placing warning signs or other demarcations as required by state and federal law or job specifications. Typically, a sign having alternating stripes 86 and 90 is provided. Usually the stripes will be white and orange so as to provide maximum visibility for drivers. However, those familiar with traffic control will appreciate that numerous other signs could be placed on the face 82.

Disposed on lateral sides of the face 82 are a pair of ribs 94. The ribs 94 extend forwardly from the face 82 so that when the panel member 18 of the delineator 10 is impacted by an automobile, the projecting ribs shield the sign from damage as the panel member breaks free of the base member 14 and slides across the road.

Figure 2:
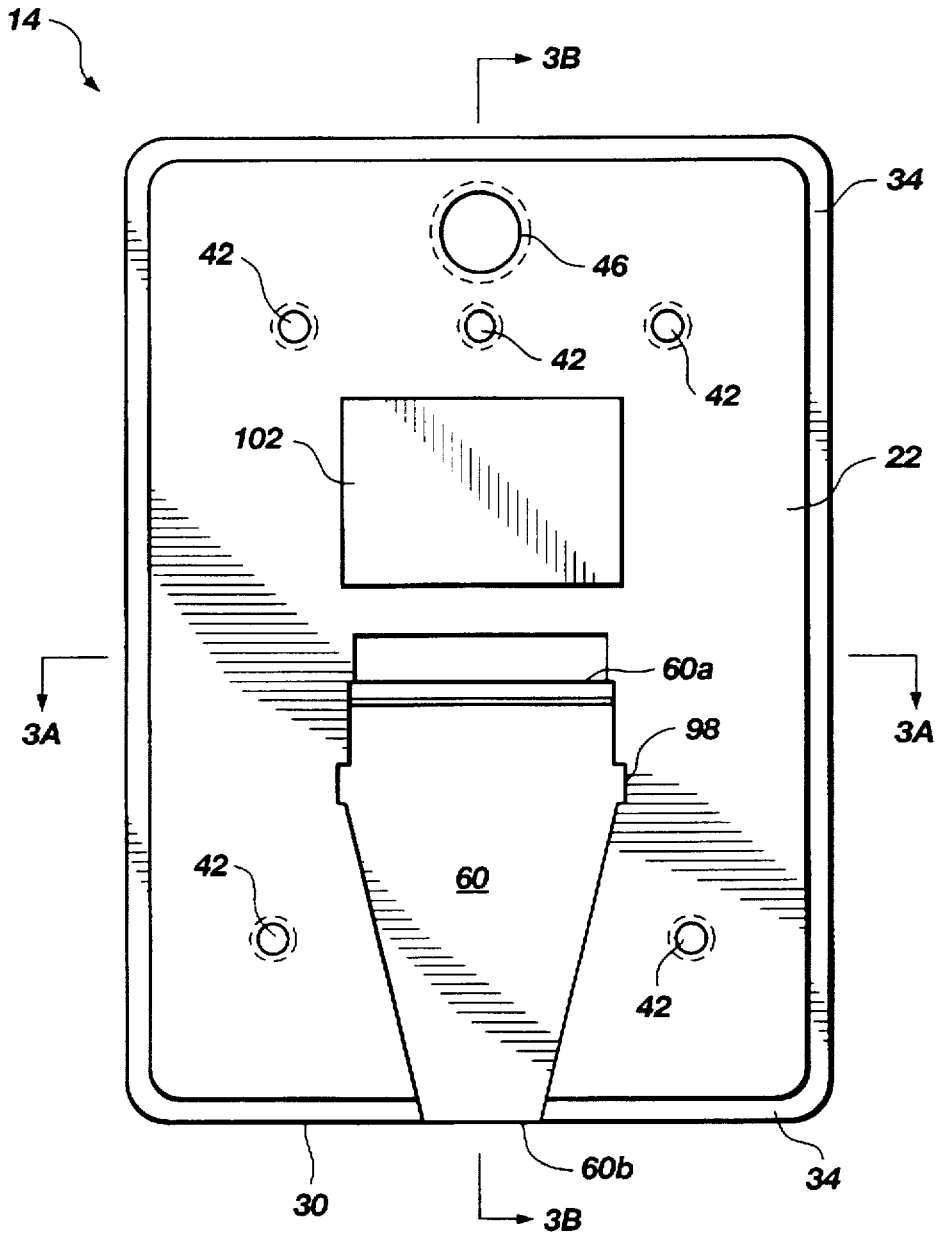
FIG. 2 shows a top view of the base member shown in FIG. 1.

Referring now to FIG. 2, there is shown a top view of the base member 14. The base member 14 has an upper surface 22 with a groove 34 formed therein about the perimeter. The groove is typically between one-quarter of an inch and three-quarters of an inch wide. The groove 34 will typically be about one-half inch deep to provide sufficient interlocking with a contact rim 38 of another base member to prevent sliding of the two base members with respect to one another.

Positioned at various points in the upper wall 22 are the vents 42 which allow both air and water to pass therethrough. One significant problem with many base members of the prior art is that if the base is tipped somewhat due to a sudden gust of wind contacting a panel member, the base member can act as a kite, providing additional surface for the wind to contact and thereby resulting in the delineator being tipped over. The vents 42 have been found to be effective in allowing a sufficient amount of the wind to pass therethrough that the base member 14 falls back to the road surface correctly and returns the panel member 18 to the desired position.

Also shown in FIG. 2 is the receiving slot 60. The receiving slot 60 extends from an inner portion **60*a* of the base member 14 into which the panel member 18 (FIG. 1) is mounted, to an opening 60*b* formed in the sidewall 30. The opening 60*b* allows the panel member 18 to nest within the base member to retain a substantially horizontal orientation. The opening 60*b* is sufficiently deep that the top of the panel member 18 is disposed at or below the bottom of the groove 34 at the perimeter of the base member 14. Of course, if the opening 60*b* were not deep enough to allow the upper surface of the panel member 18 to be at or below the bottom of the groove 34, an indentation could be formed in the contact rim 38 of each base member 14** to compensate.

As shown in FIG. 2, the receiving slot 60 has a broad portion 98 which is disposed so as to receive the shoulder 74 on the panel member 18 when the panel member is disposed generally horizontally. The receiving slot then tappers inwardly as it approaches the opening **60*b*. This accommodates the tapering of the neck portion 64*a* of the panel member which is tapered inwardly so as to minimize the amount of resistance provided to wind while simultaneously providing sufficient support for the upper portion of the panel member 18. Of course, the receiving slot 60 could be of any shape or size, and need not follow the contours of the neck portion 64 (FIG. 1) of the panel member 18** (FIG. 1).

Also shown in FIG. 2 is an identification plate 102 which may be added to the base member 14, or which may be integrally formed therewith. The identification plate 102 will typically have the name of the owner of the delineator 10 cut or formed therein to inhibit theft of the delineator.

Figure 3A:
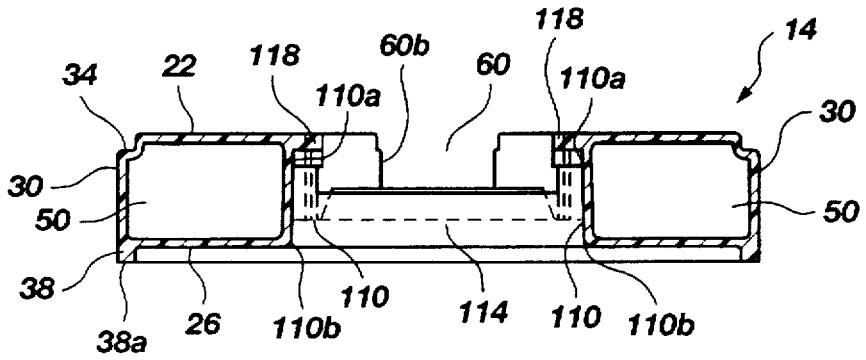
FIG. 3A shows a cross sectional view of the base member of FIG. 2 taken along the line 3A.

Referring now to FIG. 3A, there is shown a cross-section view of the base taken through the receiving slot 60. The base member 14 has the upper wall 22, the lower wall 26 and a sidewall 30 joining the two as described with respect to FIG. 1. Disposed at the top of the sidewall 30 is the groove 34 into which a contact rim (such as contact rim 38) of another base member is positioned when a plurality of base members are stacked on top of one another. Extending from the bottom of the sidewall 30, opposite the groove 34, is the contact rim 38.

In addition to facilitating the stacking of base members 14 on top of one another, the contact rim 38 also provides a surprisingly efficient mechanism for keeping the base member 14 properly positioned on the surface of a roadway. Specifically, at the bottom of each contact rim 38 is formed by a generally planer surface **38*a* which is typically between one-quarter and three-quarters of an inch wide. Because the contact rim 38 extends downwardly beyond the lower wall 26, all of the weight of the collapsible, breakaway delineator 10 is supported by the contact rim. This results in a much larger contact pressure for the breakaway delineator 10 than is conventionally provided by a base member with a flat bottom. For example, if the base member is 15 inches by 20 inches and the contact rim 38 is one-half inch wide, the planer bottom surface 38*a*** will provide only 35 square inches of contact with the road surface. This results in a pressure of slightly over 1 and one-quarter pounds per square inch. In contrast, a conventional base would have a surface area for contacting the road of approximately 300 square inches. Such a broad surface area would provide an effective pressure of slightly more than fifteen hundredths of a pound per square inch. Thus, while less area is actually in contact with the road surface, the frictional engagement is higher because of the pressure.

In addition to focusing the weight on a small area, the contact rim 38 also prevents a phenomenon commonly referred to as crawling or snaking. Because delineators are placed along roadways where they are subjected to gusts of wind and are positioned in close proximity to passing vehicles, the delineators 10 are constantly subjected to vibrations. This is especially true on interstate freeways which are heavily traveled by tractor-trailer trucks. As the vehicle passes, the draft created by the vehicle causes a vibration in the breakaway delineator 10. As the vibration is passed to the base member, the base member moves slightly on the road due to the changing contact between the flat surface of the base member and the roadway. While the movement typically only amounts to small fractions of an inch with each pass, the delineator can move a substantial distance over several hours on a heavily traveled road.

In contrast to the prior art, the base member 14 of the present invention dramatically decreases crawling/snaking. When the delineator is vibrated sufficiently to cause movement, the amount of movement is significantly less due to the fact that the amount of the contact rim 38 which engages the roadway is nominal, i.e. less than 20 percent and preferably between 5 and 15 percent of the overall area of the base. It is important that the contact rim 38 be at least long enough to prevent the lower surface 26 from contacting the roadway due to vibrations. This enables the contact rim 38, to dampen vibrations. Preferably, the contact rim is of sufficient length that the lower surface will not contact the roadway even if the base member is rolled over by an automobile tire. Thus, the base member 14 of the present invention can be passed in close proximity hundreds of times while the movement of the base member is so small as to be barely noticeable.

Also shown in FIG. 3A is an inner wall 110 which defines lateral sides of a vertical receiving channel 114 which is used to hold the lower end 18*a* of the panel member 18 (FIG. 1) when the panel member is disposed generally vertically. The inner walls 110 have a 2 degree outward draft as they extend downward. The small nubs 112 (FIG. 5A) disposed on the lower end 18*a* of the panel member 18 interact with the inner walls 110 to form a means for holding the lower end in place. This is accomplished by positioning the nubs 112 in such manner on the lower end 18*a* of the panel member 18 that they are pressed inwardly to a greater extent when the nubs 112 are disposed adjacent a upper end 110*a* of the inner wall 110, and to a lesser extent when they are disposed adjacent a lower end 110*b* of the inner wall 110. Such an arrangement keeps the lower end 18*a* of the panel member 18 securely in the receiving channel 114 unless an upward force is provided which overcomes the resistance within the lower end. The upward force can be provided either by a person pulling upwardly on the panel member 18 so as to release the lower end 18*a*, or by the force of a vehicle forcefully impacting the panel member.

A retaining wall 118 is provided adjacent to the upper end 110*a* of the inner wall 110. The retaining wall 110 prevents the nubs 112 from being pulled out of the receiving channel 114 unless a considerable amount of force is provided. Thus, when a construction worker pulls upwardly with sufficient force to overcome the biasing of the lower end 18*a* of the panel member 18 and the draft of the inner wall 110, the panel member will rise until the nubs 112 contact the retaining wall 118. Releasing the panel member 18 will allow it to then fall into a horizontal orientation in which the neck portion 64 nests within the receiving slot 60. In contrast, if a vehicle impacts the panel member 18 at a high rate of speed, the upward force provided will generally be sufficient to pull the nubs 112 past the retaining wall 118, thereby allowing the panel member 18 to break away from the base member 14. Should such occur, the panel member 18 can be quickly reattached by road construction/repair crews.

Figure 3B:
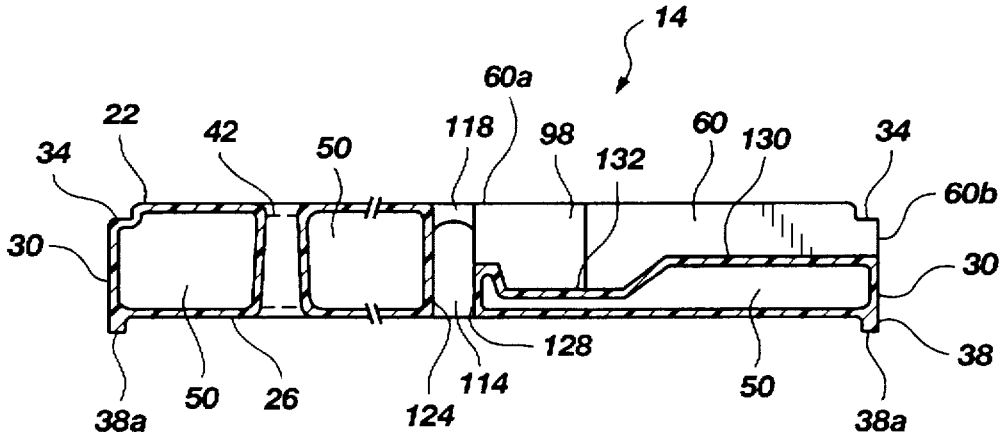
FIG. 3B shows a cross sectional view of the base of FIG. 2 taken along the line 3B.

Referring now to FIG. 3B, there is shown a cross-sectional view of the base member 14 taken along the long axis of the receiving slot 60. Beginning at the left of the figure, there is shown the sidewall 30 and the groove 34 and contact rim 38 which are disposed at opposing ends thereof. Formed between the sidewall 30 and the upper wall 22 and the lower wall 26 is the void 50 which can be filled with sand or other weighting material. The cross-sectional view of FIG. 3B also shows one of the vents 42 which allows air and water to pass between opposing sides of the base member 14.

Disposed in the middle of the base member 14 is the receiving channel 114. The receiving channel 114 is formed by two generally vertical walls. A first generally vertical wall 124 extends from the upper wall 22 to the lower wall 26. A second generally vertical wall 128 extends upwardly from the lower wall 26 and terminates approximately half way to the upper wall 22. A center wall 130 extends from the top of the second generally vertical wall 128 in an inner portion 60*a* of the base member 14 to the sidewall 30 to define the bottom of the receiving slot 60. A contoured portion 132 may be provided for receiving a thickened portion 136 (FIG. 4B) of the neck portion 64 of the panel member 18.

The first and second generally vertical walls 124 and 128 form the receiving channel 114 and hold the panel member 18 in a generally vertical orientation as long as the lower end 18*a* is positioned between the walls. To provide a secure support, the lower end 18*a* of the panel member 18 should have a thickness which is almost the same as the distance between the first and second generally vertical walls 124 and 128. To enable the panel member 18 to pivot into the horizontal orientation, the lower end 18*a* need only be raised so that the nubs 112 are positioned above the top of the second generally vertical wall 128. Because the second wall 128 is shorter, it will not provide support to the lower end 18*a* when the nubs 112 are positioned there above, and the panel member 18 will be able to rotate into the horizontal orientation. Because of the outward draft of the inner walls 110 and position of the nubs 112 discussed in detail with respect to FIG. 3A, however, the panel member 18 will not be able to rotate unless a firm upward force is applied thereto overcome the anchoring mechanism 70. The retaining wall 118 prevents over withdrawal of the lower end 18*a* unless the panel member 18 is impacted with a significant amount of force. The underside 118*a* of the retaining wall 118 is typically concave for receiving the nubs 112 of the panel member 18 and to facilitate rotation thereof.

Figure 4:
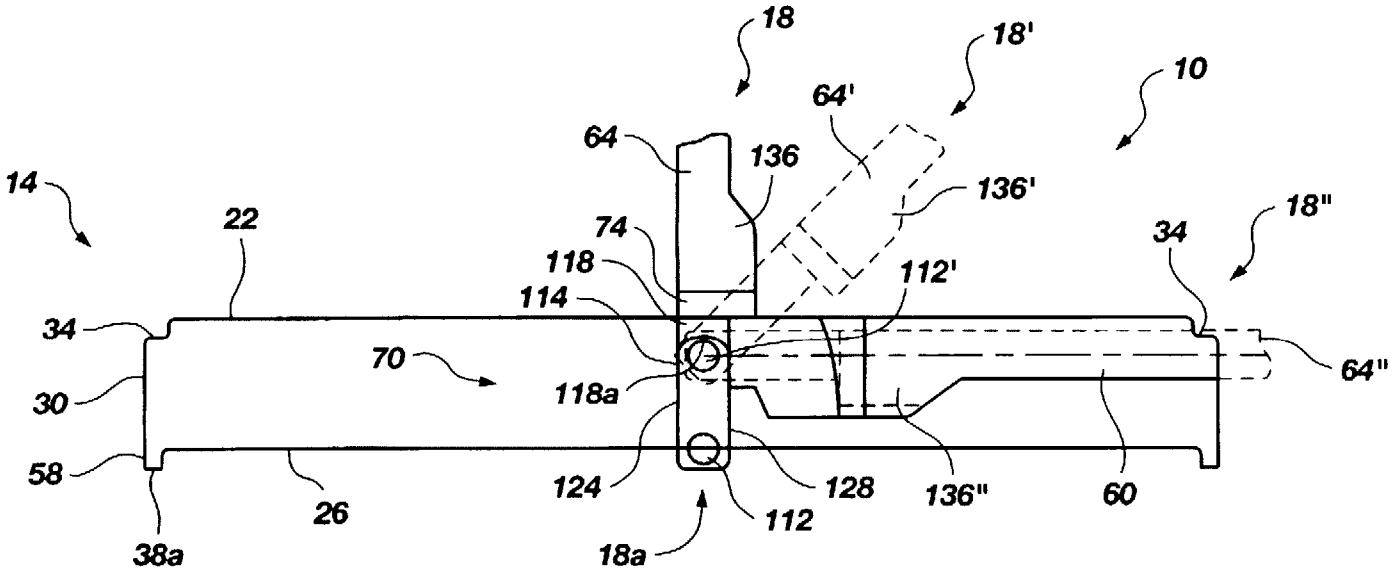
FIG. 4 shows a close-up view of the base member and a lower end of the panel member disposed therein in three different positions.

Referring now to FIG. 4, there is shown a side view of the base member 14, and a three fragmented views of the panel member 18 demonstrating the positions of the panel member as it is moved between generally vertical and generally horizontal orientations. The base member 14 includes the upper wall 22 and the lower wall 26. The sidewall 30 is also shown with the groove 34 and the contact rim 38 disposed on either side thereof.

Positioned within the receiving channel 114 is the lower end 18*a* of the panel member 18. The lower end 18*a* is inserted so that the collar 74 contacts the upper wall 22 of the base member 14. In such a position, the bottom of the lower end 18*a* will typically touch or be immediately adjacent to a surface on which the base member 14 is resting, and the nubs 112 will be positioned adjacent to the lower wall 26 of the base member.

When the lower end 18*a* of the panel member 18 is disposed in the receiving channel 114, the first and second generally vertical walls 124 and 128 provide counter faces which securely hold the opposing sides of the lower end in a generally vertical orientation. The lower end 18*a* is biased in the receiving channel due to the interaction of the nubs 112 and the inner wall 110 discussed in detail with respect to FIG. 3A. The draft on the inner walls 110 provides less inward pressure on the nubs 112 when they are disposed adjacent the lower wall 26, than when they are disposed adjacent the retaining wall 118.

If sufficient upward force is applied to the panel member 18 to overcome the biasing provided by the nubs 112 and the draft of the inner walls 110, the lower end 18*a* will be moved upwardly until the nubs (as indicated at 112') are positioned adjacent the retaining wall 118. In such a position, the second generally vertical wall 128 no longer provides support to the lower end 18*a* of the panel member 18, and the panel member is able to rotate about the nubs 112' as indicated by the neck 64' and the contoured portion 132'. The rounded underside 118*a* of the retaining wall 118 facilitates rotation about the nubs 112.

Once the lower end 18*a* of the panel member 18 is no longer supported by the second, generally vertical wall 128, the panel member's own weight will cause it to fall into a generally horizontal orientation indicated at 18". When the panel member 18" is disposed generally horizontally, the neck portion 64", including the contoured portion 132" are nested within the receiving slot 60 in the base member 14. While in FIG. 4 the neck portion 64" of the panel member 18" is shown to extend slightly above the bottom of the groove 34, the neck portion will generally rest sufficiently deep within the receiving sot 60 so that an upper surface will be at or below the bottom of the groove.

If an extreme amount of force is applied, such as an vehicle impacting the panel member 18, the nubs 112' will be pulled beyond the retaining wall 118. With the nubs 112' no longer disposed within the receiving channel 114, the panel member 18' will no longer be held to the base member 14 and will "breakaway". When a vehicle impacts a conventional sign mounted on a moveable base, the base typically pivots upward into the undercarriage of the vehicle and causes considerable damage. If the base is sufficiently large, it can even become lodged under the vehicle and cause the driver to lose the ability to control the vehicle's direction of travel. This, of course, can lead to additional accidents.

By breaking away from the base member 14, the panel member 18 decreases the damage to the vehicle dramatically. While impacting a conventional sign may result in thousands of dollars in damage to the vehicle, tests with the present invention have shown body damage is likely to be limited to breaking a headlight.

An additional advantage of the invention is that it provides much lower risk of secondary accidents than other devices such as barrels or cones. If the panel member 18 is thrown into oncoming traffic, it will typically slide across the road. If impacted by a vehicle, the impact will typically take place at the tire and will cause no damage to the vehicle. If the panel member 18 comes to rest on the roadway, it can be driven over without damaging the vehicle because it is typically only about an inch thick. In contrast, numerous accidents occur with barrels, cones and other devices because of drivers swerving to miss the device as it flies across the road, or drivers who must rapidly apply their brakes due to the presence of a barrel or cone in the middle of their lane.

Figure 5A:
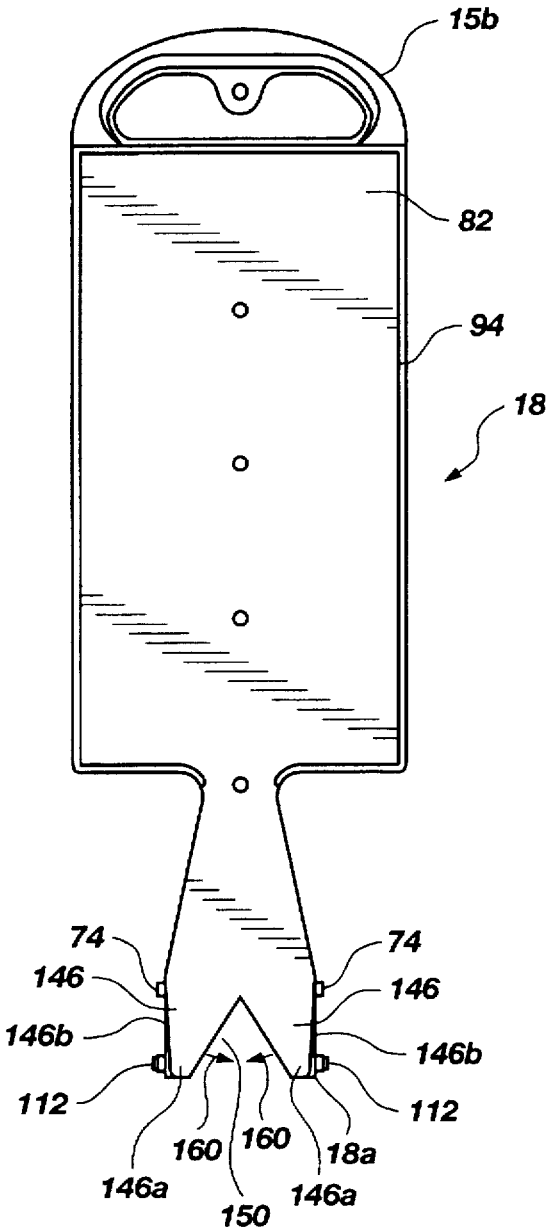
FIG. 5A shows a front view of the delineator member disassembled from the base member.
Figure 5B:
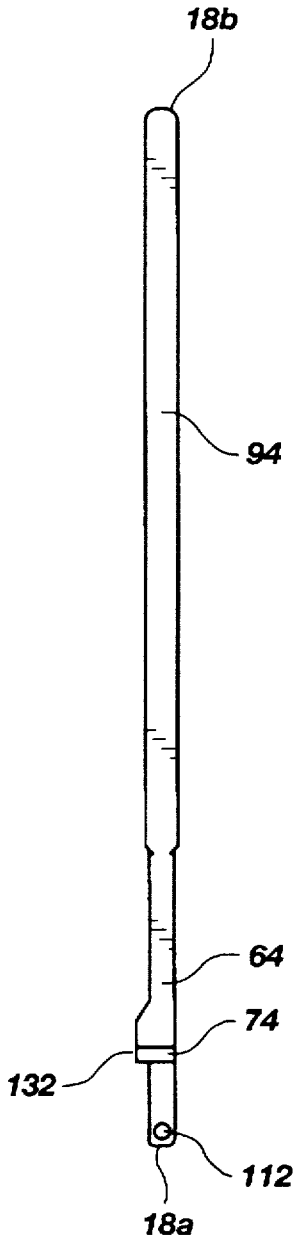
FIG. 5B shows a side view of the delineator member shown in FIG. 5A.

Referring now to FIGS. 5A and 5B, there are shown front and side views, respectively, of the panel member 18. At the lower end 18*a*, there are two tapered arms 146 with a v-shaped void disposed therebetween. One nub 112 is disposed adjacent a bottom end 146*a* of each of the arms 146. The outer, lateral sides 146*b* of the arms 146 are either substantially parallel or are tapered outwardly slightly as they approach the lower end 18*a*. The distance between the lateral sides 146*b* of the arms 146 is slightly smaller than the distance between the inner walls 110 (FIG. 3A) so that as the nubs 112 engage the inner walls, the arms 146 are compressed towards one another, as indicated by arrows 160. As the nubs 112 move downwardly along the inner walls 110, the draft of the walls decreases the degree of compression between the arms 146. Thus, the interaction of the arms 146, nubs 112 and inner walls 110 creates a biasing mechanism which is part of the anchoring mechanism 70 (FIG. 1) . The shoulder 74 prevents the lower end 18*a* of the panel member 18 from being inserted so far into the base member 14 that the nubs 112 pass beyond the bottom end 110*b* (FIG. 3A) of the inner walls. If such were to occur, the panel member 18 would be very difficult to move from the generally vertical orientation to the generally horizontal orientation.

The handle 78 disposed in the upper end 18*b* facilitates movement of the panel member 18 between the generally horizontal orientation and the generally vertical orientation. The handle 78 also assists the user in pulling upwardly on the panel member 18 to dislodge the lower end 18*a* from the receiving channel 114 and allows crews placing or retrieving the delineators 10 to conveniently lift them.

Referring specifically to FIG. 5B, those skilled in the art will appreciate that the contoured portion 132 provides additional support to the neck portion 64 to prevent the neck portion from breaking when it is forcibly impacted by an automobile. If the neck portion 64 is thicker or provided with a more rounded cross-section, the contoured portion 132 can be omitted.

To facilitate the use of the delineator 10 in the manner described above, it is important that the panel member be at least semi-resilient. Thus, materials such as polyethylene or other semi-resilient composites may be used. It is preferable to use such materials which can withstand temperatures down to at least –40 degrees Fahrenheit before becoming brittle. Otherwise, the panel member 18 may shatter upon impact and cause greater damage to the vehicle. To this end, it has been found that cross-linked polyethylene is a preferred material for both the base member 14 and the panel member 18.

Figure 6:
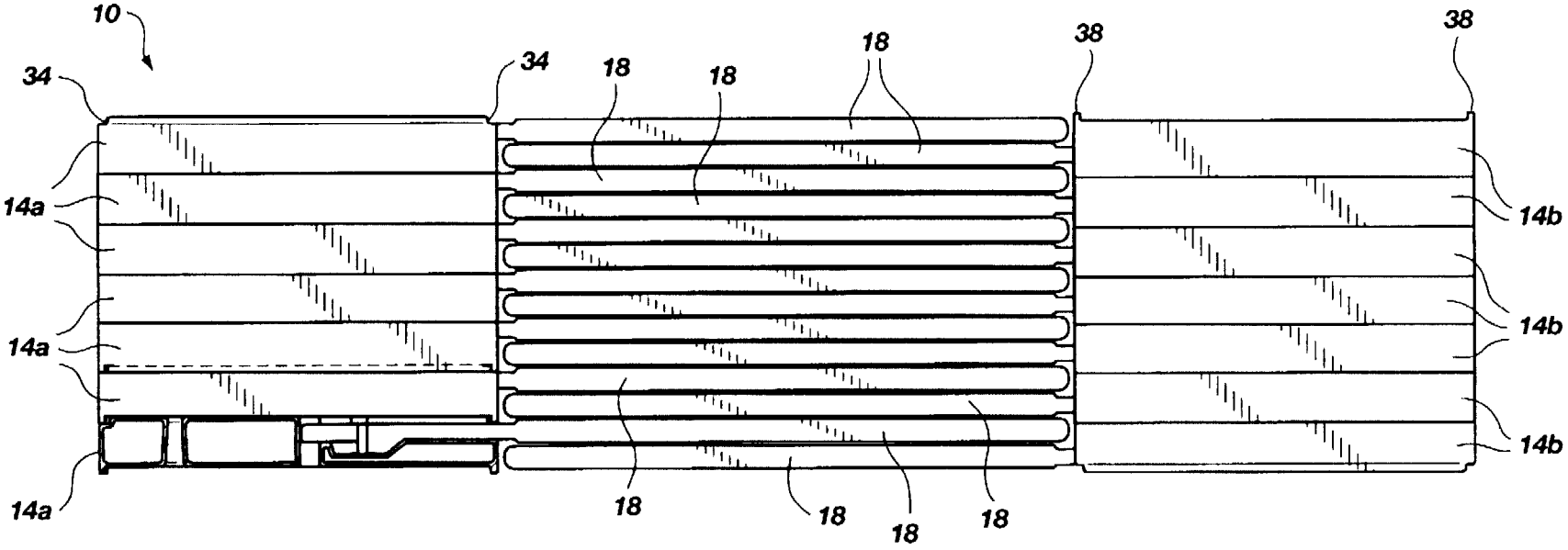
FIG. 6 shows a side view of a plurality of breakaway delineators made in accordance with the present invention and stacked into a configuration for transport.

Referring now to FIG. 6, there is shown a side view of a plurality of delineators, all generally indicated at 10, which are stacked in an arrangement to minimize the amount of space consumed. The base members 14 are stacked one on top of the other, and the panel members 18 are disposed generally horizontally and in a configuration parallel with one another. To fully maximize the number of breakaway delineators 10 which may be stored or transported in a given volume, a first group of base members 14*a* are positioned right side up, and a second group of base members 14*b* are positioned upside-down. This allows the panel members to be slid together like a deck of playing cards. In a space of 15 inches by 60 inches by 36 inches, twenty to twenty-four delineators 10 can be stacked.

Such an arrangement is a marked improvement over the prior art. Traditional delineators which have a weighed base would typically require a volume four to six times as large to properly hold a similar number. Thus, a single truck can carry many times as many delineators 10 of the present invention as those of the prior art.

Figure 7A:
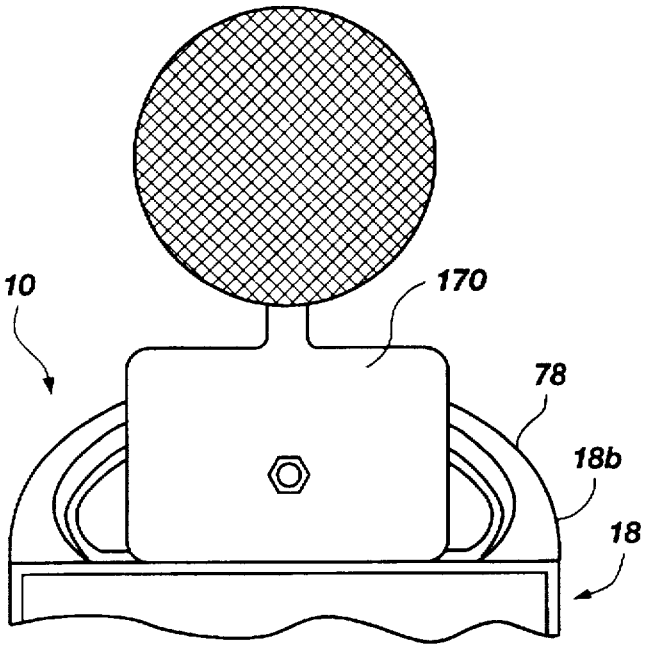
FIG. 7A shows a fragmented view of an upper end of the delineator member with a conventional flashing light attached thereto.
Figure 7B:
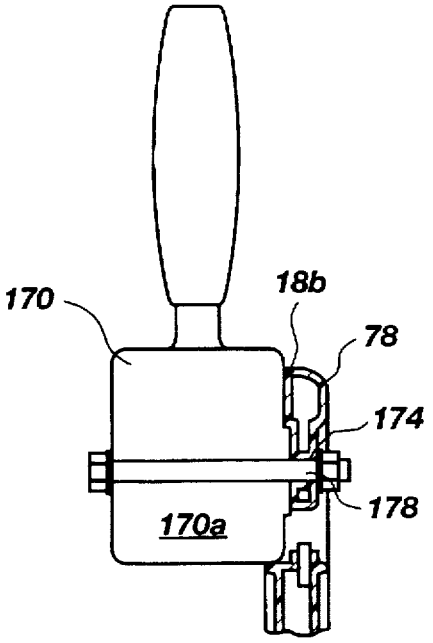
FIG. 7B shows a cross-sectional view of the handle portion shown in FIG. 7A with the conventional flashing light attached thereto.

Referring now to FIGS. 7A and 7B, there are shown fragmented front and partial cross-sectional views of the upper end 18*b* of the panel member 18 of the present invention and a traditional flashing warning light 170 which is attached to the handle 78. One major concern with many delineator devices is their incompatibility with other equipment. A contractor who owns hundreds of traditional flashing lights will be hesitant to move to new delineators if the new delineators require additional expenditures to replace properly operating equipment.

As shown in FIG. 7B, a hole 174 is formed in the handle portion 78 to accommodate traditional warning lights. A bolt 178 is passed through a housing 170*a* of the warning light 170, and through the hole 174. A nut 182 is then attached to hold the bolt in place. In such a manner, the traditional warning lights 170 may continue to be used as long as they are functional.

Figure 7C:
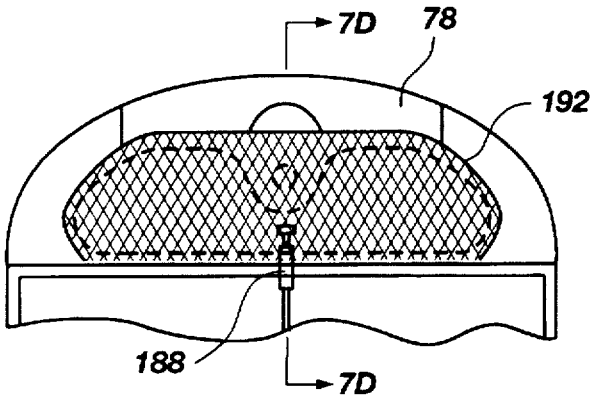
FIG. 7C shows a fragmented view of the upper portion of the delineator member forming a handle with a light emitting diode and reflector positioned therein.
Figure 7D:
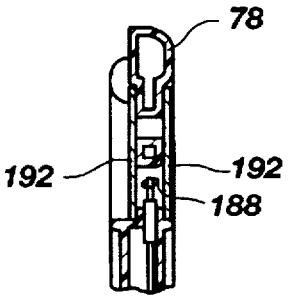
FIG. 7D shows a cross-sectional view of FIG. 7C taken along the line 7D.

In FIGS. 7C and 7D, there are shown a front view and a cross-sectional view of the handle 78 with a light emitting diode 188 disposed therein. A one-way reflector 192 is disposed on either side of the hollow of the handle 78 to protect the light emitting diode 188 and to provide coloration such as yellow or red.

The light emitting diode 188 has the advantage that it consumes considerably less energy than the bulb used conventional warning light 170. Additionally, because the entire unit fits within the handle 78, the light emitting diode version can be left in place in the handle without interfering with the stacking method shown in FIG. 6. Furthermore, such an embodiment increases the likelihood that the warning light will survive any situation in which the panel member 18 breaks away from the base member 14.

Those skilled in the art will appreciate that numerous modifications may be made to the present invention without departing from the scope or spirit thereof. For example, in FIG. 8 there is shown a side view of an alternate embodiment of delineator 210, made in accordance with the principles of the present invention. The delineator 210 has a base member 214 and a panel member, indicated in a generally vertical orientation at 218 and in a generally horizontal orientation at 218'.

Figure 8:
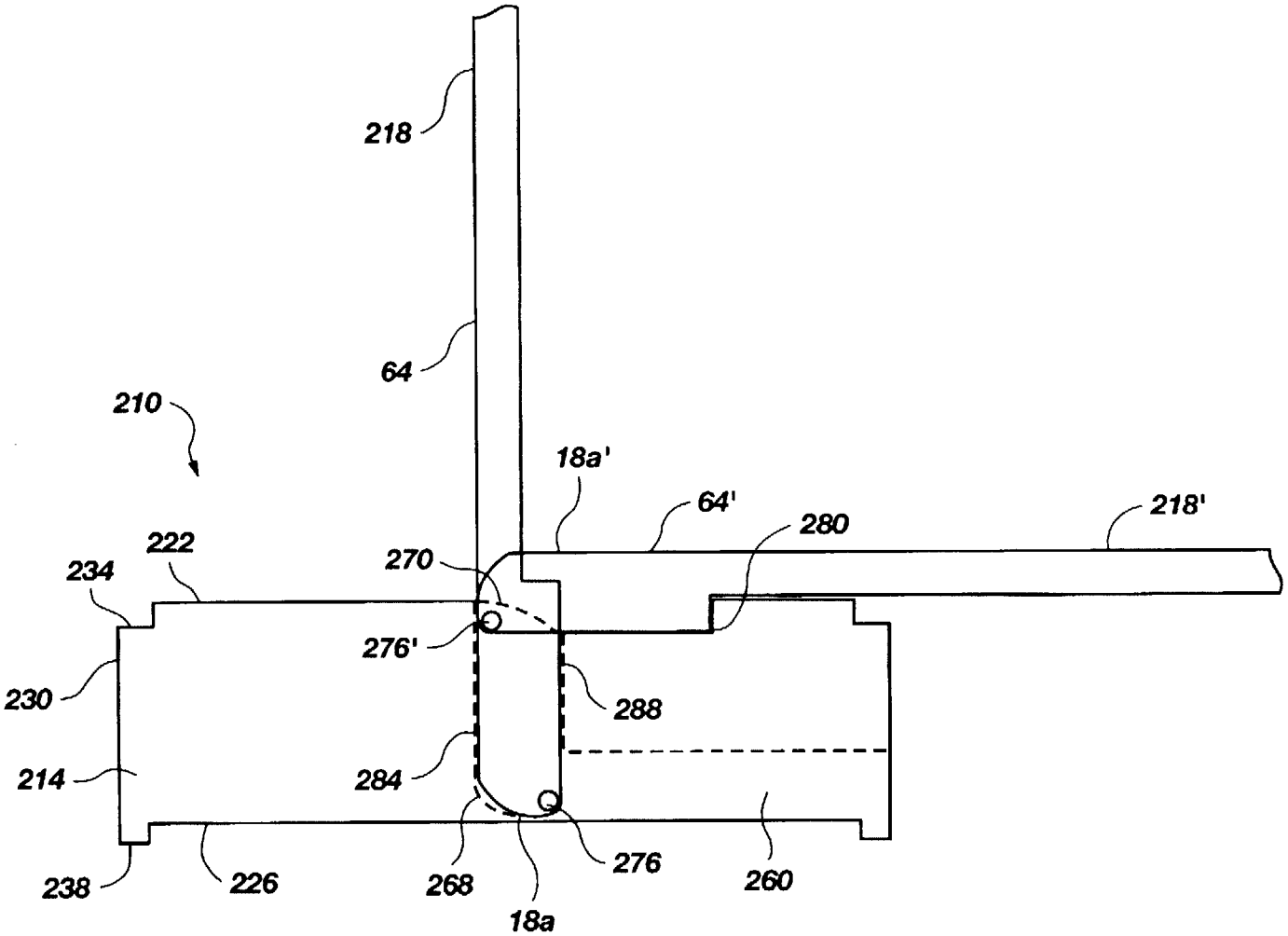
FIG. 8 shows an alternate embodiment of the present invention wherein the receiving slot in the base member is configured to receive the panel member of another base member when in a stacked position.

The base member 214 has an upper wall 222, a lower wall 226, a sidewall 30 and a contact rim 38 and groove 34 which forms a tongue and groove arrangement similar to that discussed with respect to FIGS. 1 and 2. The primary difference with the embodiment of FIG. 8 is that the receiving slot 260 is formed in the bottom of the base member 214. The receiving slot 260 is designed to hold the neck portion of the panel member of an adjacent base member. Thus, as a second base member is stacked upon a first base member, it will hold the panel member of the first base member. Such a configuration also provides a mechanism for preventing slippage between base members without the need for the contact rim and groove, 38 and 34, respectively.

To enable the panel member 218' to extend above of the base member 214 when disposed horizontally, modifications must be made to the lower end, 218*a* or 218*a*'. One manner of achieving such an arrangement is to provide a broader base portion and a broader receiving channel 268 in the base member 214. The first and second generally vertical walls 284 and 288 hold the lower end 18*a* generally vertical as long as the lower end is held therebetween.

A retaining wall 270 is disposed along the receiving channel 268. As the nub 276 is pulled upwardly, it engages the retaining wall 270 which slides the nub into the position shown at 276'. As the retaining wall moves the nub 276' toward the left, the panel member 218 is forced into a generally horizontal orientation as indicated at 218'. As shown in FIG. 8, a portion of the base member 214 forms a secondary receiving slot 280 for holding a portion of the lower end 218*a*'. However, those skilled in the art will appreciate numerous ways in which the base member/panel member interaction could be modified to remove the necessity of a secondary receiving channel 280.

Once the panel member 218' is disposed generally horizontally, numerous base members 214 may be stacked on top of one another. The panel members 218' can be interlaced as described with respect to FIG. 6.

Thus there is disclosed an improved collapsible, breakaway high delineator. Those skilled in the art will appreciate numerous modifications which can be made within the scope and spirit of the invention. The appended claims are intended to cover such modifications.

What is claimed is:

1. A highway delineator for indicating boundaries on a roadway, the delineator comprising:

a base member having a sidewall defining (i) an outer perimeter, and (ii) an inner portion contained within the sidewall, and having a vertical cavity formed in the inner portion and extending through the sidewall; and a panel member having a lower end disposable in the base member, an upper end and an intermediate body between the upper and lower ends, the lower end including lateral side walls having lateral release means for releasable attachment of the lower end to the base member such that a portion of the intermediate body nests within the cavity of the base member when the panel member is disposed in a generally horizontal orientation, but can be rotated upward to a stable, generally vertical orientation.

2. The highway delineator of claim 1, wherein the base member comprises an anchoring means for engaging the lateral release means of the panel member to attach the panel member to the base member, and for selectively holding the panel member in the generally vertical orientation.

3. The highway delineator of claim 2, wherein the anchoring means comprises a receiving channel defined by opposing generally vertically disposed walls for holding the lower end of the panel member in a generally vertical orientation.

4. The highway delineator of claim 3, wherein the generally vertically disposed walls defining the receiving channel comprise a first vertical wall, and a second vertical wall which is shorter than the first vertical wall, the first and second vertical walls being disposed such that when the lower end of the panel member is disposed therebetween, the panel member is held in the generally vertical orientation, and when the lower end is pulled above the second vertical wall, the panel member may be pivoted into the generally horizontal orientation.

5. The highway delineator of claim 4, wherein the anchoring means further comprises a pair of inner walls disposed adjacent the first and second generally vertical walls, and wherein the inner walls are disposed to engage the lower end of the panel member to form a biasing means for biasing the lower end to remain between the first and second vertical walls unless an upward force is applied to the panel member.

6. The highway delineator of claim 5 wherein the inner walls have upper ends and lower ends with an outward draft extending from the upper ends to the lower ends, and wherein the lower end of the panel member is laterally compressible between the outward draft, the lower end being disposed in the receiving channel such that the lower end of the panel member is compressed to a greater extent adjacent the upper ends of the inner walls than adjacent the lower ends of the inner walls so as to bias the lower end to remain adjacent the lower ends of the inner walls.

7. The highway delineator of claim 6, wherein a retaining mechanism is disposed adjacent the upper ends of the inner walls, and wherein the lower end of the panel member comprises at least one projection disposed so as to engage the retaining mechanism and limit upward movement of the lower end of the panel member.

8. The highway delineator of claim 7, wherein the at least one projection can be pulled beyond the retention mechanism without breaking either the retention mechanism or at least one projection when the panel member is forcibly impacted by an automobile at a speed in excess of approximately 20 mph.

9. The highway delineator of claim 1, wherein the intermediate body of the panel member has a tapered neck portion, and wherein the cavity is formed such that the tapered neck portion nests at least partially within the cavity when the panel member is in the generally horizontal orientation.

10. The highway delineator of claim 1, wherein the base member has an upper surface and a lower surface, a tongue formed so as to extend downwardly from the lower surface of the base member, and a groove formed in the upper surface of the base member for receiving the tongue of a like configured base member in a tongue and groove arrangement when a plurality of base members are disposed on top of one another.

11. The highway delineator of claim 10, wherein the groove has a bottom surface and wherein the cavity is sufficiently deep that when the panel member is nested within the cavity, the panel member does not extend above the bottom surface of the groove.

12. The highway delineator of claim 10, wherein the tongue and groove are disposed about the perimeter of the base member.

13. The highway delineator 12, wherein the tongue forms a contact rim disposed about the perimeter of the base member, the contact rim having a bottom, generally planar surface for engaging the roadway.

14. The highway delineator of claim 13, wherein the base member is weighted and has a bottom/lower wall having an area, and wherein the planar surface of the contact rim has an area not greater than 20 percent of the area of the lower wall.

15. The highway delineator of claim 14, wherein the contact rim extends downwardly from the bottom/lower wall of the base member a sufficient distance to prevent the bottom wall from contacting the roadway when the base member is vibrated.

16. The highway delineator of claim 1, wherein the base member has an upper wall and a lower wall, and wherein at least one vent extends from the upper wall through the lower wall.

17. The highway delineator of claim 1, wherein the upper end of the panel member comprises a handle.

18. The highway delineator of claim 1, wherein the upper end has an attachment means for connecting a warning light to the panel member.

19. The highway delineator of claim 18, wherein the upper end further comprises a slot having a light emitting diode disposed therein, and a reflective member disposed adjacent the light emitting diode.

20. A highway delineator for marking boundaries and hazards on a roadway, the delineator comprising:

a panel member having lateral side walls at a lower end of the panel member, said lateral side walls including lateral release means which releasably engage a supporting base member, said panel member being disposable in a generally vertical orientation when attached to a base member; and a base member attached to the lower end of the panel member, the base member having a void for receiving a weighting material and a bottom wall with a surface area and including a contact rim substantially positioned around a perimeter of the bottom wall and extending downwardly therefrom, the contact rim providing a planar contact surface whose total surface area is nominal relative to the surface area of the bottom wall of the base, the contact rim being disposed so that substantially all vertical loading occurs on the planar contact surface of the contact rim to increase frictional resistance against movement of the base member along the roadway, the contact rim being of sufficient height and rigidity to prevent contact of the bottom wall with the roadway when the void of the base member is filled with the weighting material.

21. The highway delineator of claim 20, wherein the base member has an upper wall with a groove formed therein for receiving the contact rim of another base.

22. The highway delineator of claim 20, wherein a plurality of vents are disposed to extend through the base member.

23. A highway delineator for marking boundaries and hazards on a roadway, the delineator comprising:

a base member having an outer perimeter, an inner portion disposed within the outer perimeter and having an upper surface and a lower surface and a receiving slot extending into the base member from one of the upper and lower surfaces of the inner portion of the base member for receiving a portion of a panel member when the panel member is disposed in a horizontal orientation, the receiving slot extending from the inner portion of the base member through a sidewall defining the outer perimeter of the base member; and a panel member having lateral side walls at a lower end of the panel member and including lateral release means to enable the panel member to be pivotally attached to the base member and moveable between a generally vertical orientation and a generally horizontal orientation.

24. The highway delineator of claim 23, wherein the receiving slot is formed in the base member on a side opposite the panel member such that when a plurality of base members are stacked upon one another, the panel member is disposed in the receiving slot of an adjacent base member.

25. The highway delineator of claim 24, wherein the base member comprises a secondary receiving slot for receiving a portion of the panel member attached to said base member.

26. The highway delineator of claim 25, wherein the base member has a lower wall and a sidewall, and a contact rim extending downwardly from the sidewall, and wherein the receiving slot is disposed in the base so as to extend outwardly through the sidewall and through the contact rim.

27. The highway delineator of claim 23, wherein the receiving slot adjacent the pivotable attachment of the panel member is disposed in the base member.

28. A breakaway highway delineator for marking boundaries and hazards on roadways, the delineator comprising:

a panel member having lateral side walls at a lower end thereof, said lateral side walls including lateral release means capable of being attached to a base member, said panel members being moveable between a generally vertical orientation and a generally horizontal orientation; and a base member attached to the lower end of the panel member for selectively supporting the panel member; and anchoring means for selectively holding the panel member in the generally vertical orientation and for maintaining attachment between the panel member and the base member when the panel member is disposed in the generally horizontal orientation, the anchoring means including said lateral release means for releasing the attachment between the panel member and the base member when the panel member is forcefully impacted while disposed in the vertical orientation.

29. The highway delineator of claim 28, wherein the base member has a bottom wall and a contact rim extending downwardly therefrom, the contact rim having a planar contact surface for engaging the roadway.

30. The highway delineator of claim 28, wherein the anchoring means comprises a generally vertically disposed receiving channel and a lower end of the panel member moveable within the receiving channel between a first position wherein the lower end of the panel member is held generally vertical and a second position, wherein the lower end is not held generally vertical, thereby enabling rotation of the panel member into the generally horizontal orientation.

31. The highway delineator of claim 30, wherein the anchoring means further comprises biasing means for biasing the lower end of the panel member into the first position.

32. The highway delineator of claim 31, wherein the biasing means comprises a pair of inner walls disposed on either sides of the receiving channel, each of the walls having an upper end and a lower end, there being an outward draft from the upper end to the lower end.

33. The highway delineator of claim 32, wherein the lower end of the panel member is laterally compressible, and wherein the lower end is disposed within the receiving channel such that the inner walls provide a compressing force against the lower end, the compressing force being greater at the upper end of the inner walls than at the lower end of the inner walls so as to bias the lower end of the inner walls toward the lower end of the inner walls.

34. The highway delineator of claim 28, wherein the lower end of the panel member comprises a plurality of nubs extending outwardly therefrom so as to contact the inner walls defining the receiving channel.

35. The highway delineator of claim 30, further comprising an retention mechanism for inhibiting movement of the lower end of the panel member out of the receiving channel.

36. The highway delineator of claim 30, further comprising a shoulder disposed about the panel member for limiting movement of the lower end of the panel member within the receiving channel.

* * * * *